US007048367B2

(12) United States Patent
Roberts

(10) Patent No.: US 7,048,367 B2
(45) **Date of Patent: *May 23, 2006**

(54) PRECONDITIONING MEDIA FOR EMBOSSING

(75) Inventor: Carrie Roberts, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 44 days.

This patent is subject to a terminal disclaimer.

(21) Appl. No.: 10/407,631

(22) Filed: Apr. 4, 2003

(65) Prior Publication Data

US 2004/0196348 A1 Oct. 7, 2004

(51) Int. Cl.
*B41J 2/01* (2006.01)

(52) U.S. Cl. ..... 347/101; 347/100

(58) Field of Classification Search ..... 347/100, 347/101, 96, 95, 102, 105, 103; 399/1; 400/1; 428/32.1; 700/1; 106/31.27, 31.13, 31.6; 523/160

See application file for complete search history.

(56) References Cited

U.S. PATENT DOCUMENTS

| | | | | |
|---|---|---|---|---|
| 3,440,076 | A | | 4/1969 | Vaurio |
| 4,095,233 | A | | 6/1978 | Goffe |
| 4,101,688 | A | | 7/1978 | Kurtzman |
| 4,227,200 | A | | 10/1980 | Mansukhani |
| 4,312,268 | A | | 1/1982 | King et al. |
| 4,599,627 | A | | 7/1986 | Vollert |
| 4,756,758 | A | | 7/1988 | Lent et al. |
| 4,792,860 | A | | 12/1988 | Kuehrle |
| 4,793,280 | A | | 12/1988 | Menard et al. |
| 4,805,531 | A | | 2/1989 | Sarda |
| 4,849,883 | A | | 7/1989 | Mitchell et al. |
| 4,943,816 | A | * | 7/1990 | Sporer ..... 347/101 |
| 4,991,539 | A | | 2/1991 | Sarda |
| 5,145,519 | A | | 9/1992 | Kappele |
| 5,157,761 | A | | 10/1992 | Hawkes |
| 5,164,232 | A | | 11/1992 | Henseleit et al. |
| 5,207,825 | A | | 5/1993 | Schwarz, Jr. |
| 5,252,264 | A | | 10/1993 | Forderhase et al. |
| 5,286,286 | A | | 2/1994 | Winnik et al. |
| 5,328,504 | A | | 7/1994 | Ohnishi |
| 5,345,254 | A | | 9/1994 | Wong et al. |
| 5,387,380 | A | | 2/1995 | Cima et al. |
| 5,397,673 | A | | 3/1995 | Watson et al. |
| 5,563,694 | A | | 10/1996 | Katayama |
| 5,618,338 | A | | 4/1997 | Kurabayashi et al. |
| 5,627,578 | A | * | 5/1997 | Weintraub ..... 347/101 |
| 5,699,743 | A | | 12/1997 | Ganz et al. |
| 5,940,674 | A | | 8/1999 | Sachs et al. |
| 6,007,318 | A | | 12/1999 | Russell et al. |
| 6,106,110 | A | | 8/2000 | Gundjian et al. |

(Continued)

FOREIGN PATENT DOCUMENTS

| | | |
|---|---|---|
| EP | 0403264 | 12/1990 |

(Continued)

OTHER PUBLICATIONS

Clear Inc., Invisible Imaging "say more—see nothing".

(Continued)

*Primary Examiner*—Manish S. Shah

(57) ABSTRACT

A preconditioning process is disclosed that provides applying a first fluid to a media; applying a second fluid including an ink to the media, at least a portion of which is applied over the first fluid, wherein a sufficient amount of the first fluid extends a drying time of the second fluid; and applying an embossing powder to the media before the second fluid has substantially dried.

25 Claims, 6 Drawing Sheets

U.S. PATENT DOCUMENTS

| | | | | |
|---|---|---|---|---|
| 6,193,361 | B1 | 2/2001 | Wen | |
| 6,350,022 | B1 * | 2/2002 | Takemura et al. | 347/96 |
| 6,375,874 | B1 | 4/2002 | Russell et al. | |
| 6,428,148 | B1 * | 8/2002 | Gore | 347/101 |
| 6,428,155 | B1 | 8/2002 | Silverbrook et al. | |
| 6,471,426 | B1 | 10/2002 | Shepherd et al. | |
| 6,480,217 | B1 | 11/2002 | Inoue et al. | |
| 2001/0020964 | A1 * | 9/2001 | Irihara et al. | 347/43 |
| 2004/0153204 | A1 * | 8/2004 | Blanco | 700/207 |
| 2004/0183878 | A1 | 9/2004 | Roberts | |

FOREIGN PATENT DOCUMENTS

| | | | |
|---|---|---|---|
| JP | 2000238344 | A | 9/2000 |
| JP | 2001353907 | A | 12/2001 |
| WO | WO 93/25336 | | 12/1993 |
| WO | WO 98/28124 | | 7/1998 |

OTHER PUBLICATIONS

Clear Inc., "Clear Is Cool!".
U.S. Appl. No. 10/394,117, Apr. 5, 2005.

* cited by examiner

PRECONDITIONING MEDIA FOR EMBOSSING

RELATED APPLICATION

This application is related to copending application Ser. No. 2004/0183878 filed Mar. 21, 2003, entitled "Embossing Using Clear Ink," which is commonly assigned with the present invention.

BACKGROUND

Embossing is a technique that produces raised or depressed portions on a surface in accordance with the shape and contours of a desired pattern or design. With some prior embossing techniques, images or text are printed in ink on a media, such as paper. The media is ejected from the printing device and an embossing powder is applied and adheres to portions of the media where the ink remains wet. Thereafter, the media is heated to melt the powder and produce raised or "embossed" portions.

With some inkjet printers, it is often difficult to create a document where the ink remains wet long enough to proceed with embossing. It is also difficult to get consistent embossing results through a full range of color prints because the primary colored inks often dry at different rates, causing the powder to stick inconsistently.

Varieties of colored embossing powders are available to provide a desired color affect to a document being embossed. However, relying upon multi-colored powders to achieve desired color affects may be limiting in a number of circumstances. Among other things, the ability to achieve a desired affect could be substantially restricted by the unavailability of one or more colored powders. Further, such powders may have to be embossed separately to avoid undesirable mixing or blending of different colored powders.

Another disadvantage of some prior embossing techniques is their inability to emboss areas of a media where no visible ink has been applied.

For these and other reasons, there is a need for the present invention.

SUMMARY

An embodiment of the invention is directed to a preconditioning process that, inter alia, provides for applying a first fluid to a media; applying a second fluid comprising ink to the media, at least a portion of which is applied over the first fluid; and applying an embossing powder to the media before the second fluid has substantially dried.

Other aspects of the invention will be apparent to those skilled in the art after reviewing the drawings and the detailed description below.

BRIEF DESCRIPTION OF THE DRAWINGS

Embodiments of the present invention will now be described, by way of example, with reference to the accompanying drawings, in which.

DETAILED DESCRIPTION

It is to be understood that the present invention may be embodied in other specific forms without departing from its essential characteristics. The illustrated and described embodiments are to be considered in all respects only as illustrative and not restrictive. The scope of the invention is, therefore, indicated by the appended claims rather than by the included description. All changes that come within the meaning and range of equivalency of the claims and included elements are to be embraced within their scope.

Figure 1A:
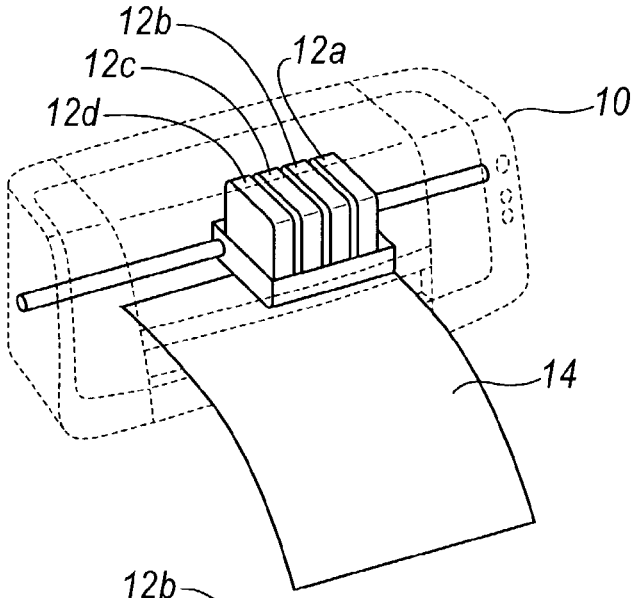
FIGS. 1A through 1C are perspective schematic views of a printing device for embossing according to several embodiments of the present invention.
Figure 1B:
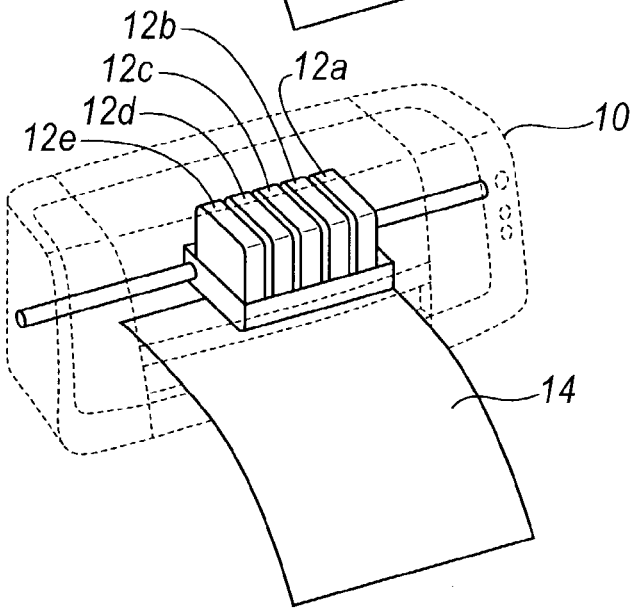
Figure 1C:
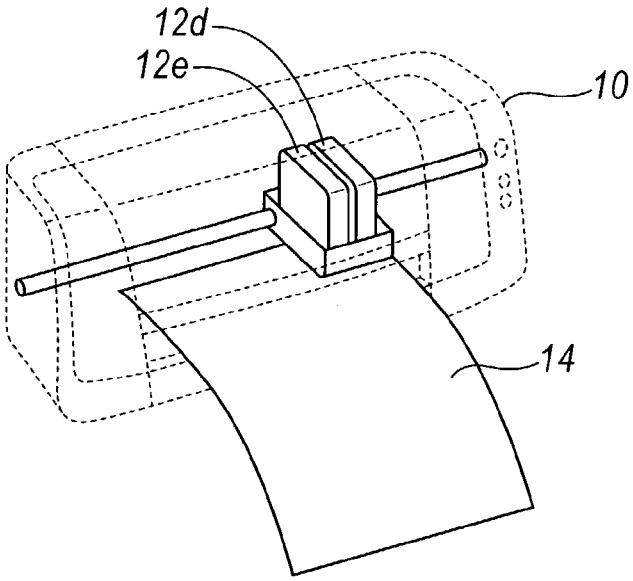

Referring now to FIGS. 1A–1C, embodiments of the present invention are shown and described. In FIG. 1A, a printer 10 is shown including ink cartridges, which are generally identified as element 12. The term "cartridges" is used herein in a broad sense and may include, without limitation, a wide variety of liquid and ink delivery devices associated with printing mechanisms. In the illustrated embodiment, printer 10 uses ink cartridges 12*a*, 12*b*, 12*c* and 12*d* to apply ink and other substances to media 14, which is generally illustrated as a print media. Printer 10 includes processing or control devices that communicate with the ink cartridges 12 to dispose ink from the cartridges onto the surface of the media 14 in desired amounts and at desired locations. Media 14 is run through or otherwise disposed within printer 10 and is comprised of paper or other known printable material. Non-limiting examples of the interaction of print cartridges with a printer for disposing ink or other liquid on a media are generally disclosed in U.S. Pat. No. 6,471,426, which is incorporated herein by reference.

Referring again to the embodiment of FIG. 1A, four ink cartridges, 12*a* through 12*d* are depicted. Ink cartridges 12*a*, 12*b*, and 12*c* may include primary colors, such as magenta, yellow, and cyan. As will be readily understood to one skilled in the art, these or other primary colors can typically be combined to print a variety of colors. Additionally, in accordance with an embodiment of the invention, ink cartridge 12*d* is also provided.

Ink cartridge 12*d* includes a base or saturating ink or liquid (referred to hereinafter as a "base liquid"). In one embodiment, the base liquid is an invisible, transparent, clear or substantially clear ink or other liquid (i.e., "clear ink" or "clear liquid") to keep ink applied over it from distorting in color. However, it is understood that the base liquid need not be clear and could be a colored liquid. Generally, the base liquid can be comprised of any desirable liquid that does not destroy the media 14, allows colors on the media 14 to show without unacceptable distortion, and provides sufficient saturation characteristics to ensure that ink applied over it remains wet for a sufficiently long drying time to permit embossing after the visible ink has been applied to the media 14. An example of a base liquid that may be used in an ink cartridge, such as illustrated ink cartridge 12*d*, is one commercially marketed by Inc.jet Inc. of Norwich, Conn. under the trade designations "inc jet" and "clear.inc". In another embodiment, the clear liquid used is (or substantially includes) water.

The use of a base liquid having certain sufficient saturation characteristics with respect to the associated media to help ensure that ink applied to or overlaid on the base liquid remains wet for a desired duration. By first being absorbed to a given extent by the media, the base liquid can help ensure that ink which is subsequently applied over the base liquid is not quickly (or as quickly) absorbed into the media and dried.

For example, in one embodiment, a base liquid is absorbed by and saturates the media to a level or extent that is close to the saturation point of that respective portion of the media. The saturation of the media with the base liquid better ensures that subsequent ink, which is applied or overlaid on the base liquid, will be absorbed by the media at a significantly lesser extent or slower rate than if no base liquid had been applied. Of course, the amount of base liquid that is applied to one or more portions of the media can be any amount that is sufficient to extend the drying time of the ink, which is to be subsequently applied over it, to a desired extent or for a desired amount of time. As such, the level of saturation of the base liquid does not have to be at or closely approach the maximum saturation level of the media. In fact, the level of saturation of the base liquid can be any lower amount that provides that the subsequent ink overlaid upon it will remain wet or un-dried for a sufficiently long period of time, for example, to accommodate subsequent processing such as an embossing procedure. As used herein, the term "drying time" is meant to be the amount of time that it takes an ink or liquid, which has been applied to a media, to become dry or substantially dry to the touch or for the application of another material, such as a powder.

Moreover, both the base liquid and overlaid ink can be used for inkjet or other embossing techniques where all of the inks applied to the surface of a media could be wet at the same time. Further, in some cases, both the base liquid and the visible ink have the same or very similar relative drying rates and/or times with respect to a given media. With embodiments of the invention, the saturation of the first ink can be used to extend the drying time of the second ink overlaid upon the first ink.

The base liquid can be selected from an ink or liquid that does not undesirably degrade or distort the printed image below it or distort the ink printed or otherwise applied on top of it. Further, because the selected base liquid can be clear or substantially clear, the base liquid can be applied below and/or above virtually any color text or design on the media without unacceptably distorting the text or design.

Further, if desired for some applications, a clear embossing powder can subsequently be applied and used to produce a raised or embossed affect without unacceptably distorting the printed matter beneath the embossed portion. With such embodiments, essentially any color of embossing can be achieved using a single, clear or substantially clear embossing powder.

Referring now to FIG. 1B, another embodiment of the invention is shown and described. In FIG. 1B, an additional ink cartridge 12*e* is shown. Ink cartridge 12*e* may contain a single, dark color of ink (e.g., black) for printing a desired color text without the need for combining inks from several cartridges. The use of the cartridge 12*e* may be of particular use in instances when black text may be all that is required by the user or printer. For some applications, particularly where the number of cartridges is limited, the additional cartridge 12*e* may instead be swapped in or out with one of the other cartridges. However, depending upon the circumstances, including those that would place an undesirable burden on the user, the cartridge 12*e* may be maintained in the printer 10.

In FIG. 1C, another embodiment of the invention is shown and described. Here, only ink cartridges 12*d* and 12*e* are shown. Thus, the printer 10 for the embodiment depicted in FIG. 1*c* may for instance print just a black ink and a base liquid on the media 14. One skilled in the art will readily recognize that numerous combinations of ink cartridges may be used, and that the invention is not intended to be limited to only the embodiments that are shown and described herein.

Referring to FIGS. 2A through 2G, the operation of an embodiment of the invention is shown and described in additional detail. However, it is understood that the illustrated embodiment is not restrictive and any of the ink cartridge configurations shown in FIG. 1A, 1B, or 1C, as well as any additional cartridge configurations understood by one skilled in the art may instead be employed.

In one embodiment of the operation, the media 14 is first preconditioned. This may be accomplished by applying a base liquid to one or more portions of a surface of the media, which includes those portions that will be embossed. In this embodiment, the base liquid is applied before subsequent ink is applied to produce a desired text, image, and/or design. The portion of the media that is at or in proximity to the portion intended to be subsequently embossed can be preconditioned or saturated to a level of at or below the maximum saturation capacity for that portion of the media. However, it is desired that the extent and level of preconditioned saturation does not prevent or unacceptably hinder the subsequent application of ink or printing. The preconditioning or pre-saturation of the media 14 by the base liquid, in turn, helps reduce the drying rate or time of the subsequent ink or printing to thereby better ensure that the portions of the media including a base liquid remain wet when an embossing powder is later applied thereto.

Figure 2A:
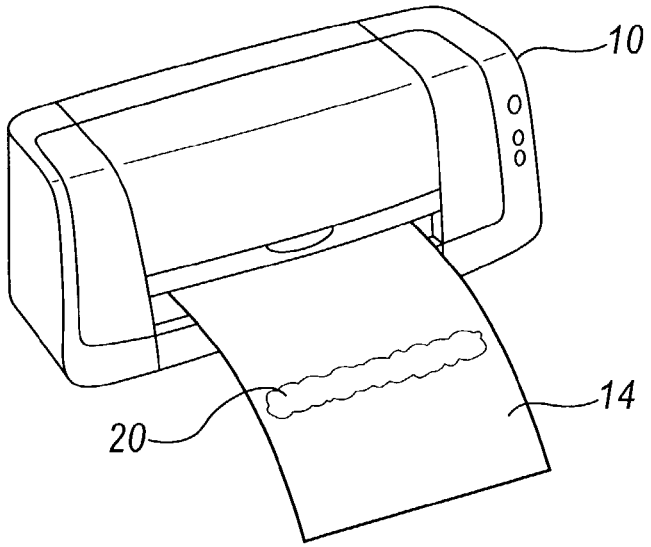
FIGS. 2A through 2G are perspective schematic views of a printing device for embossing according to another embodiment of the present invention.

In FIG. 2A, an embodiment for preconditioning a media for embossing is shown and described. In FIG. 2A, base liquid 20 is applied to media 14, such as from a base liquid cartridge 12*d*. The base liquid is applied to one or more portions of the media 14 in the configuration or general configuration of a desired embossed image. For example, in FIG. 2A, the base liquid 20 is shown applied to the media 14 in the form of an outline or base layer for subsequently printed text. Thus, in the illustrated embodiment, the base liquid 20 is disposed on portions of the media 14 that correspond to portions of the media 14 that will eventually include a desired text, image, or design (or portion thereof) to be embossed. The preconditioning may, inter alia, include saturation of the general portion or area where the text will subsequently appear, or can be more detailed—for instance to include specific saturation of the media 14 in the form of specific text or shapes. It should also be noted that, although base liquid 20 is described with respect to a clear or substantially clear ink or liquid, if desired, a visible ink could also be used, either alone or in combination.

Figure 2B:
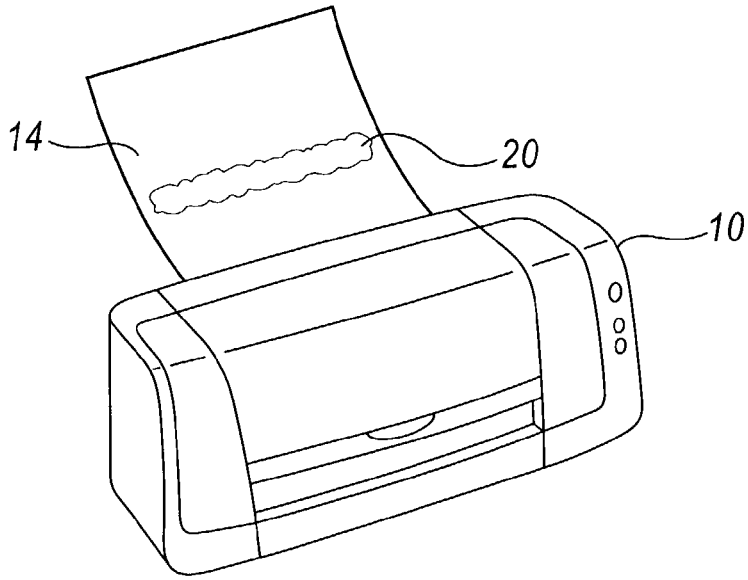
Figure 2C:
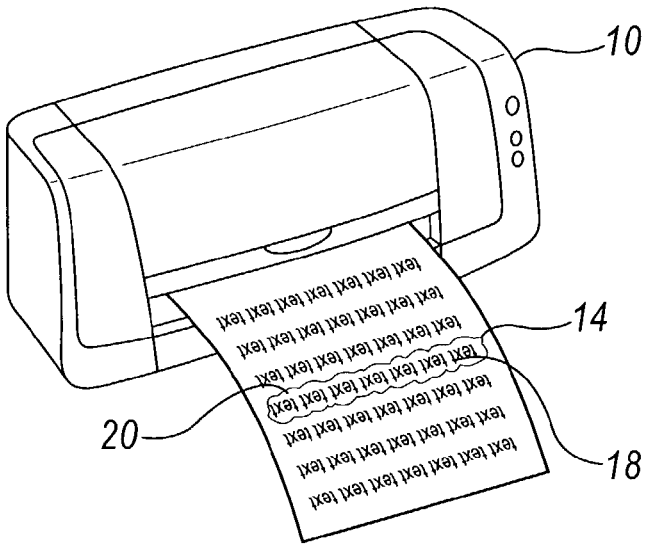

In FIG. 2B, after the base liquid 20 is applied (such as in FIG. 2A), the media 14 is "backed out" or otherwise transferred through printer 10, for example, to approximately its initial print position as shown in FIG. 2B. That is, the printer 10 advances the media 14 through the printer 10 in a direction opposite the direction of travel during the preconditioning with the base liquid 20. Then, for instance as shown in FIG. 2C, media 14 is again fed or otherwise transported through printer 10 to allow an ink cartridge (e.g., 12*a–c*) to print text on the media 14 and over portions including certain portions that include the base liquid 20. This allows the printer 10 to print the desired lettering or other desired image with ink 18 to the media 14 over a portion or area saturated or partially saturated with base liquid 20. As the media has specific saturation characteristics, the application of base liquid 20 before the actual visible ink 18 acts to pre-saturate the media 14 before application of ink 18. This results in the media 14 being unable to absorb and dry ink 18 as quickly as it would be able to without the application of base liquid 20. Accordingly, ink 18 located on base liquid 20 stays wet longer than the ink not on the base liquid 20. Consequently, subsequent application of embossing powder can be made to portions of wet ink 18 that would otherwise have dried but for the application of the base liquid 20.

Figure 2D:
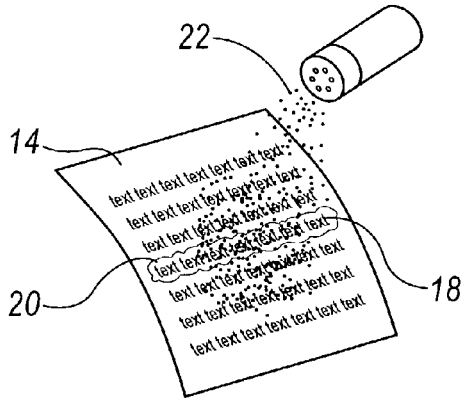

Next, as generally represented in FIG. 2D, an embossing powder 22 may be applied to media 14 so that it substantially covers the portions that include base liquid 20 and visible ink 18. The embossing powder 22 sticks or generally adheres to the still wet (i.e. non-dry) portions of ink 18 which has been applied to the base liquid 20, but does not substantially stick to the already dried portions of other visible ink on the media 14 or to the portions of the media 14 that have the liquid 20, but not the ink 18 applied thereto.

Figure 2E:
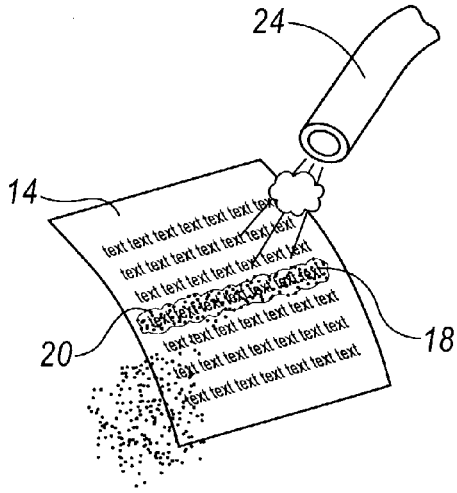

As generally illustrated in FIG. 2E, excess powder, i.e. that which did not adhere to the "wet" portions of the ink on the media, is substantially removed—typically by blowing it (as shown) or by vacuuming it away from the media or by shaking the media. In the illustrated embodiment an air gun 24 is depicted blowing the excess embossing powder 22 away from the media. However, other methods for removing excess powder as known to those in the art may also be utilized. Such alternative methods, which may or may not be non-contact, include those that employ a blowing device and/or a vacuum, those that reorient the sheet or the device and use gravity, shaking, or pouring to remove the excess powder, or those that use various combinations of one or more of the foregoing.

Figure 2F:
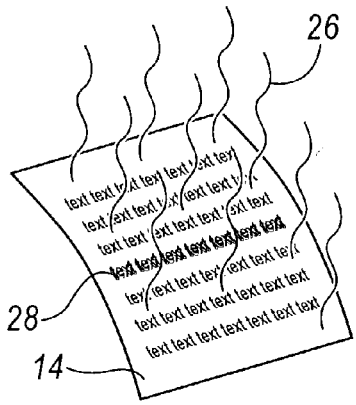
Figure 2G:
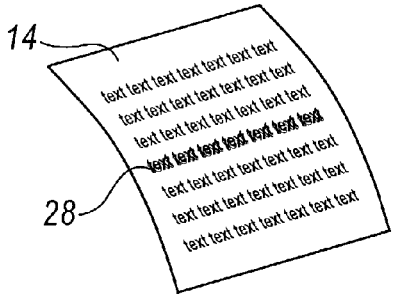

As generally represented in FIG. 2F, energy or heat 26 may then be applied to the media 14 (or select portions thereof) to activate or melt the granulites of embossing powder 22 to form an embossed portion, such as the one shown in FIG. 2G. In one embodiment, the heat 26 may be applied by an embossing gun (not shown). Further, the heat 26 may be applied to either or both surfaces of the media 14.

Figure 3A:
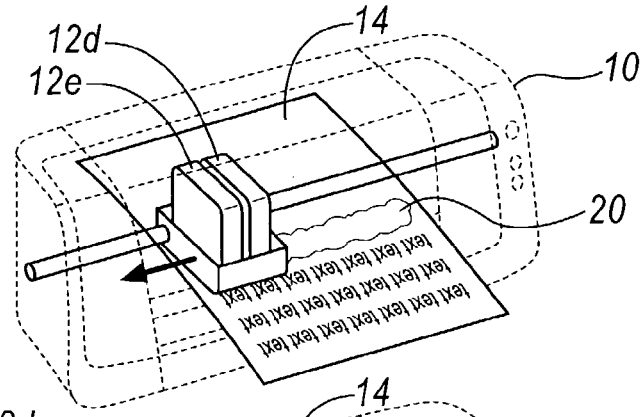
FIGS. 3A through 3H are perspective schematic views of a printing device for embossing according to another embodiment of the present invention.

Referring next to FIGS. 3A–3H, another embodiment is shown and described. The embodiment shown in FIGS. 3A–3H applies both ink 18 and base liquid 20 in a substantially line-by-line or row-by-row manner such that the media 14 is not required to be advanced through the printer 10 more than once. In FIG. 3A, an ink cartridge configuration similar to FIG. 1C is shown by way of an example. However, it is noted that any of the ink cartridge configurations previously shown or described, as well as any other configurations understood by one skilled in the art may be employed.

As generally illustrated in FIG. 3A, an ink cartridge (such as 12*d*) applies base liquid 20 to a media 14. In this particular embodiment, one single line or strip of text and/or a desired image is applied with base liquid 20 that is intended to be embossed. At some point prior to or promptly following the printing of the line or strip of ink, the printer determines whether or not a portion of the desired ink 18 is intended to be present on that line or strip and, if so, a cartridge (such as 12*e*) applies ink 18 to the appropriate location on the media 14, some or all of which may be on top of the portion or portions including base liquid 20. It is to be noted that the base liquid can be applied in a number of manners, several of which may optionally be handled by a single device based on programming and/or flexible cartridge configurations.

Figure 3B:
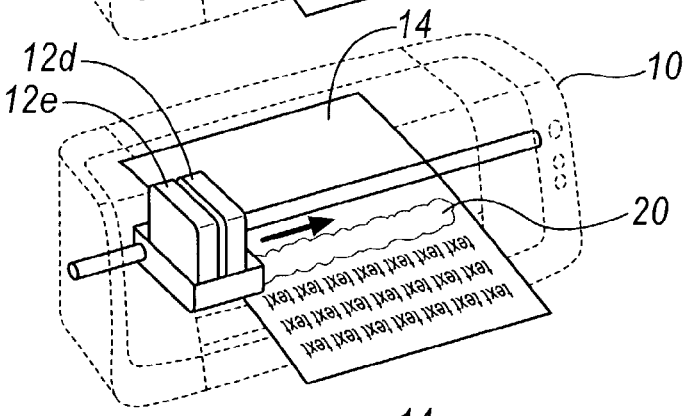

For example, as shown in FIG. 3B, a cartridge having ink 18 can "return" (or move in the opposite direction) along the same line or strip that was just printed with base liquid 20. However, if desired, a cartridge having ink 18 can follow the cartridge applying base liquid 20 and apply ink in a trailing manner in the same direction on the same print row. A configuration of the type shown in the instant embodiment may eliminate the need for the cartridges to return along the same line or strip that has just been printed. In instances in which cartridges move and follow one another in a generally linear, row-by-row manner, base liquid cartridges may optionally be included at end positions with respect to the cartridges that apply ink. In one such configuration, the printer 10 includes at least two base liquid cartridges that are separated by one or more visible ink cartridges. In this embodiment, irrespective of the direction of travel of the cartridge on a given row, a cartridge containing base liquid 20 will be available to supply ink after one or more cartridges provide visible ink to a given position on a row without requiring the cartridges to reverse direction. In addition to potentially storing a larger volume of base liquid for use, such an arrangement can permit the device to print ink and a trailing base liquid (when desired on the subject row or line) on a row-by-row type basis without requiring backtracking or repeating movement of the ink delivery means across a row more than once, which in turn can improve the speed associated with the device.

Figure 3C:
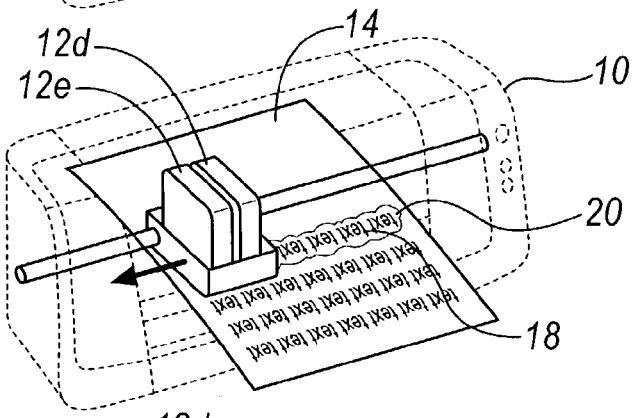
Figure 3D:
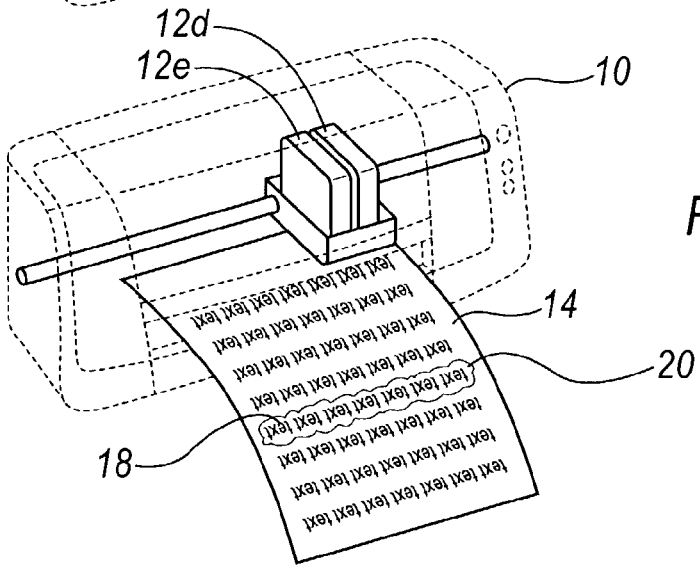

As shown by way of example in FIG. 3C, ink cartridge 12*d* has applied base liquid 20 to the desired area on media 14 along the same row or line associated with ink 18. As shown in FIG. 3D, the foregoing process may be continued line by line along the length of the page until all desired base liquid 20 and ink 18 is applied to media 14 to form both the desired inked images and embossing images.

Figure 3E:
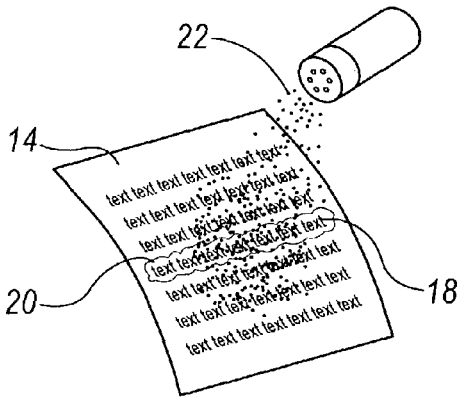

Subsequently, the finished media 14 is transferred from the printer 10 (or portion of the printer that applies ink) with the image complete thereon. In the present embodiment, the saturation of base liquid 20 keeps ink 18 in a substantially non-dry, or wet state. Next, as generally represented in FIG. 3E, an embossing powder 22, which may be thermally activated, is applied to media 14 over base liquid 20 and visible ink 18. The embossing powder 22 then sticks or adheres to the wet portions that include ink 18 disposed over base liquid 20.

Figure 3F:
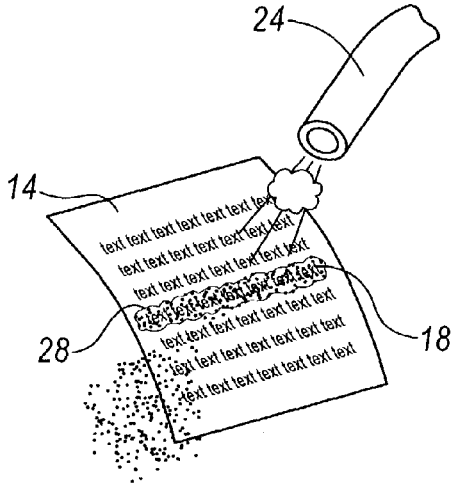
Figure 3G:
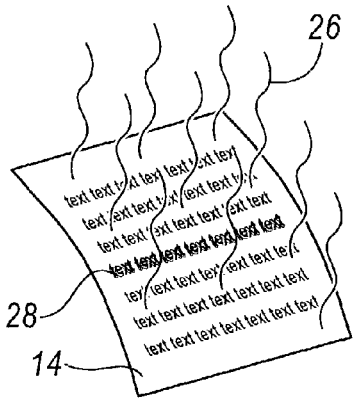
Figure 3H:
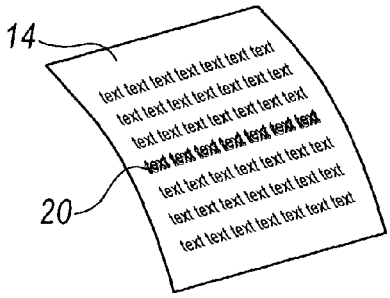

Subsequently, as previously described in connection with prior embodiments, the excess powder 22 is removed from the media 14. FIG. 3F shows one method for removing the excess powder using an air gun or other blowing means 24 to push extra powder from media 14 such that substantially only the powder 22 associated with the desired raised powder image 28 remains. As previously noted, a vacuum may also be used either in addition to or in place of the blowing means 24. As generally illustrated in FIG. 3G, energy or heat 26 is applied to the raised powder image 28 to activate and solidify the embossing powder 20 thereon. As a result of the application of energy or heat, the powder 22 is activated and results in an embossed image, such as the example shown in FIG. 3H.

Figure 4:
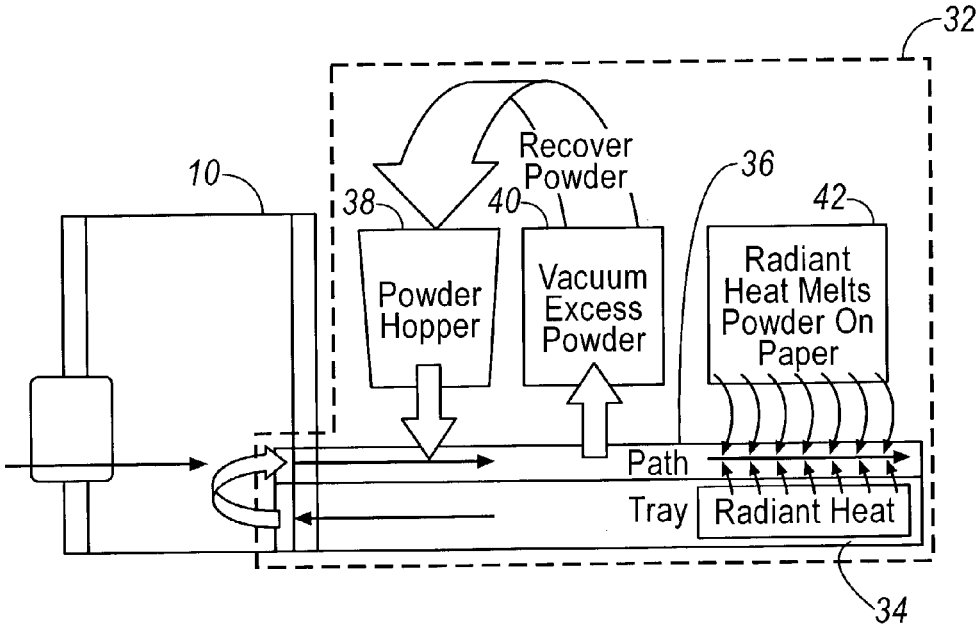
FIG. 4 is a side schematic view of a printing device for embossing according to an embodiment of the present invention.

Referring to FIG. 4, another embodiment of the present invention is shown and described. In FIG. 4, printer 10 is shown including an accessory module 32, which may or may not be connected to the printer or included as an integral component thereto. The accessory module typically includes one or more embossing related components, including, without limitation, a component for supplying and/or applying embossing powder and a component for applying energy or heat to the embossing powder at a desired time in the embossing of the media. An example of a means for supplying radiant heat to the powder is generally identified in the figure as element 34.

As shown by way of example in the illustrated embodiment, accessory module 32 may include a print media tray for storing print media, print media path 36, powder hopper 38 for storing powder 22, a removal means or vacuum 40, and a heater 42 or other means for providing energy to the media. With the inclusion of such an accessory module 32, the entire embossing process, including the associated preconditioning, may be accomplished in one convenient unit or at a single convenient work area.

While the invention has been particularly shown and described with reference to the foregoing embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A method for preconditioning a media, comprising:
applying a first fluid to the media;
applying a second fluid comprising an ink to the media on at least a portion of the first fluid, wherein a sufficient amount of the first fluid extends a drying time of the second fluid; and
applying an embossing powder to the second fluid before the second fluid is dry.

2. The method according to claim 1, wherein the first fluid comprises a clear ink or liquid.

3. The method according to claim 1, wherein substantially all of the first fluid is applied to the media before the second fluid is applied to the media.

4. The method according to claim 1, wherein:
the applying the first fluid comprises applying a row of the first fluid to the media;
the applying the second fluid comprises applying a row of the second fluid on at least a portion of the row of the first fluid;
repeating the application of first fluid and second fluid to the media row by row.

5. The method according to claim 1, wherein the second fluid comprises a visible ink.

6. The method according to claim 1, wherein the embossing powder is clear, substantially clear, or colored.

7. The method according to claim 1, further comprising:
removing excess embossing powder from the media after the embossing powder has been applied to portions of the media including the second fluid.

8. the method according to claim 7, wherein the excess embossing powder is removed by blowing, a vacuum, gravity, shaking, or pouring, or a combination of one or more of the foregoing.

9. The method according to claim 1, further comprising:
heating or providing energy to the media to activate the embossing powder.

10. The method according to claim 1, wherein the first fluid comprises visible ink.

11. The method according to claim 1, wherein the first fluid is applied with an ink cartridge of a printer.

12. The method according to claim 1, wherein the second fluid is applied with an ink cartridge of a printer.

13. An embossed image on a media, comprising:
a first fluid disposed on the media;
a second fluid comprising ink disposed on the media over at least a portion of the first fluid; and
an embossing powder adhered to at least a portion of the second fluid;
wherein a sufficient amount of the first fluid is disposed on a portion of the media to lengthen a dry time of the second fluid that is applied above the first fluid.

14. The embossed image according to claim 13, wherein the first fluid comprises a clear ink or liquid.

15. The embossed image according to claim 13, wherein the second fluid comprises a visible ink.

16. The embossed image according to claim 13, wherein the embossing powder is clear or substantially clear.

17. A printing device for preconditioning a media comprising:
a printer;
a first cartridge that comprises a first fluid;
a second cartridge that comprises a second fluid including ink;
wherein the printer is adapted to dispose the first fluid on the media and the second fluid on at least a portion of the first fluid on the media;
wherein an amount of the first fluid disposed on the media is sufficient to extend a drying time of the second fluid.

18. A printing device according to claim 17, wherein the first fluid comprises a clear ink or liquid.

19. A printing device according to claim 17, wherein the second fluid comprises visible ink.

20. A printing device according to claim 17, wherein the first fluid and the second fluid have a similar drying time.

21. A device for preconditioning and embossing a media comprising:
a printer;
a first cartridge that comprises a first fluid;
a second cartridge that comprises a second fluid including ink; and
one or more components f or embossing the media;
wherein the printer is adapted to dispose the first fluid on the media and the second fluid on at least a portion of the first fluid on the media;
wherein an amount of the first fluid disposed on the media is sufficient to extend a drying time of the second fluid.

22. A device according to claim 21, wherein the one or more components includes a component for supplying powder and a device for supplying energy or heat to the powder.

23. A device for preconditioning a media comprising:

a means for applying a first fluid; and a means for applying a second fluid including ink;

wherein the printing device is adapted to dispose the first fluid on the media and the second fluid on at least a portion of the first fluid on the media;

wherein an amount of the first fluid disposed on the media is sufficient to extend a drying time of the second fluid.

24. A device according to claim 23, including a means for applying an embossing powder to at least portions of the second fluid.

25. A device according to claim 24, including a means for supplying heat or energy to the embossing powder.

* * * * *

UNITED STATES PATENT AND TRADEMARK OFFICE

CERTIFICATE OF CORRECTION

PATENT NO. : 7,048,367 B2
APPLICATION NO. : 10/407631
DATED : May 23, 2006
INVENTOR(S) : Carrie Roberts It is certified that error appears in the above-identified patent and that said Letters Patent is hereby corrected as shown below:

In column 8, line 7, in Claim 8, before “method” delete “the” and insert -- The --, therefor.

In column 8, line 59, in Claim 21, delete “f or” and insert -- for --, therefor.

Signed and Sealed this

Twenty-sixth Day of May, 2009

JOHN DOLL
*Acting Director of the United States Patent and Trademark Office*